United States Patent [19]

Olivant

[11] 4,211,393

[45] Jul. 8, 1980

[54] VISE

[76] Inventor: Terence B. Olivant, 17 Evington Close, Leicester, England

[21] Appl. No.: 972,203

[22] Filed: Dec. 22, 1978

[30] Foreign Application Priority Data

Dec. 22, 1977 [GB] United Kingdom ..... 53377/77

[51] Int. Cl.[2] ..... B25B 5/14

[52] U.S. Cl. ..... 269/111; 269/234; 269/236; 269/268

[58] Field of Search ..... 269/229, 234–236, 269/43, 258, 268, 111

[56] References Cited

U.S. PATENT DOCUMENTS

| | | | |
|---|---|---|---|
| 419,072 | 1/1890 | Richards | 269/234 |
| 419,073 | 1/1890 | Richards | 269/234 |
| 2,686,058 | 8/1954 | Zetterberg | 269/268 |

FOREIGN PATENT DOCUMENTS

| | | | |
|---|---|---|---|
| 471838 | 3/1951 | Canada | 269/43 |
| 1179879 | 10/1964 | Fed. Rep. of Germany | 269/111 |

*Primary Examiner*—Robert C. Watson
*Attorney, Agent, or Firm*—Charles W. Helzer

[57] ABSTRACT

A vise for holding a row of discrete articles between spaced front and rear vise jaws, wherein each of the front and rear jaws has an integral side jaw at one end thereof so that the two side jaws face each other across the space formed between the front and rear jaws, and the front jaw is linearly and angularly movable relative to the rear jaw in response to actuation of clamping means, to clamp a row of articles between the front and rear jaws and along the length of the row between the side jaws. The clamping means is capable of clamping the row of articles in both directions on a single movement of a control handle.

11 Claims, 7 Drawing Figures

VISE

The invention relates to vises, and particularly to vises for holding a row of discrete articles in a disposition making them suitable for machining, for example milling, continuously along the row.

If a row of such articles were held in a conventional parallel-jawed vise, any one article which was marginally larger than the rest would receive the whole of the clamping force of the vise jaws, and the others would be to a greater or lesser extent loose.

The invention provides a vise for holding a row of discrete articles between spaced front and rear vise jaws, wherein each of the front and rear jaws has a side jaw fast at one end thereof so that the two side jaws face each other across the space formed between the front and rear jaws, and the front jaw is linearly and angularly movable relative to the rear jaw in response to actuation of clamping means, to clamp a row of articles between the front and rear jaws and along the length of the row between the side jaws.

Because the front jaw is angularly movable relative to the rear jaw, it will adjust itself to an angular orientation in which it grips at least two of the articles in the row (being the two articles which are larger than the remainder even to a marginal extent). The remainder of the articles in the row are held by the clamping action of the cooperating side jaws which act longitudinally along the row.

Preferably the clamping means is effective to clamp the row of articles in both directions on a single movement of a control member for example a cam operated by a control lever. The clamping mechanism comprises a row of wedge elements which, on movement together, urge one or more slide members transversely of the row to urge the front jaw in the clamping direction.

The advantage of having clamping in both directions effected by a single movement of the control member is that the clamping forces in the two directions are applied simultaneously and progressively. If there were any looseness between adjacent articles in the direction along the row this would be taken up before the clamping force laterally of the row became so great as to prevent movement of articles longitudinally of the row.

It is a further object of the invention to provide a vise which is capable of accommodating appreciable irregularities in the size of articles in the row, or of clamping a row of dissimilar articles, while providing identical or nearly identical clamping pressures on each of the articles. This object is achieved by mounting a row of discrete pressure members on one of the front and rear vise jaws, each of the pressure members being freely slidable longitudinally of the jaw on which it is mounted and presenting oppositely inclined contact surface portions to adjacent articles in the row. For example the pressure members may be mounted in a longitudinal groove in the appropriate jaw, and each may be a hemicylindrical domed member or a wedge-shaped member. As the vice jaws are moved together the articles of the row are initially gathered into contact with the pressure members and the opposite jaw, with the end articles of the row in contact with the side jaws. During this initial jaw movement the pressure members slide freely longitudinally of the jaws to accommodate irregularities between the articles and to provide point contact between the contact surface portions and the articles. Application of clamping pressure then causes identical or nearly identical clamping pressure to be applied to every article in the row.

This invention is hereinafter particularly described, by way of example only, with reference to the accompanying drawings, of which:

Figure 1:
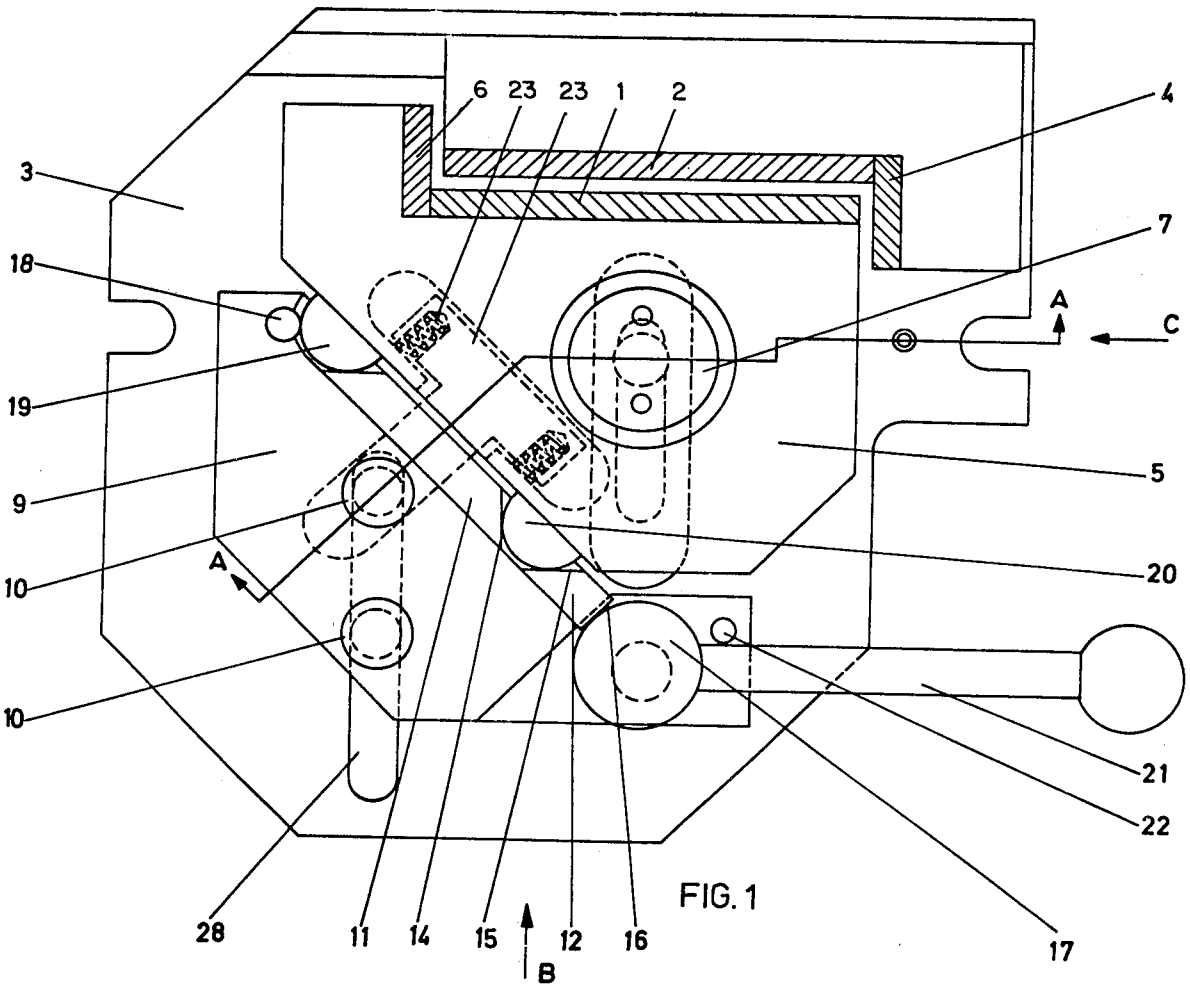
FIG. 1 is a top plan view of a vise according to this invention, with cover plates for the two jaws removed.

The vise of FIGS. 1 to 4 comprises front and rear jaws 1 and 2 respectively. The rear jaw 2 is a fixed jaw that is fast to a base plate 3 and has an associated side jaw 4 at one end thereof. A substantially perpendicular shoulder is formed between the side jaw 4 and the rear jaw 2. The front jaw 1 is a moving jaw and is mounted on a moving jaw carrier 5. Associated with the front jaw 1, and also mounted on the moving jaw carrier 5, is a side jaw 6. The side jaw 6 forms a generally perpendicular shoulder with the front jaw 1, at the end of the front jaw 1 remote from the side jaw 4 of the rear jaw 2.

The moving jaw carrier 5 is prevented from lifting away from the base plate 3 by means of a stud 7 that is secured to the base plate and has a head that overlaps a recess portion of the moving jaw carrier 5. The stud 7 has a shank 8 (FIG. 2) which is considerably smaller than the bore that is provided in the moving jaw carrier 5, so that the moving jaw carrier and the moving jaw are both linearly and angularly movable relative to the rear jaw 2.

To effect the clamping movement of the two jaws together, there is provided a clamping mechanism comprising a spacing block 9 securely mounted to the base plate 3 by means of two Allen screws 10. One face of the spacing block 9 forms a guide track for a pair of slidable cam members 11 and 12. The cam member 11 has two wedge faces 13 and 14 each inclined at an acute angle to the direction of sliding of the cam member 11. The cam member 12 has one such inclined face 15 and one face 16 that is perpendicular to the direction of sliding and abuts a rotary cam 17. At the end of the spacer block 9 remote from the rotary cam 17 is a stop pin 18, and between the stop pin 18 and the inclined face 13 is a semicircular slide 19 abutting the moving jaw carrier 5. Between the inclined surfaces 14 and 15 is an identical semicircular slide 20 abutting the moving jaw carrier 5. When the rotary cam 17 is rotated by means of a lever 21 to the position shown in FIG. 1 in which the lever abuts a stop pin 22, the rotary cam 17 biases the cam member 12 axially along its guide track, there is a resulting sliding movement of the semicircular slides 20 and 19 and of the cam member 11, and the slides are moved towards one another and out of the guide track. This is resisted by a pair of return springs 23 which are in a housing in the moving jaw carrier 5, between the moving jaw carrier and the base plate 3. Each return spring 23 is under compression between a shoulder of the moving jaw carrier 5 and a spring housing block 24 which is mounted on a spring return arm 25 fast to the spacing block 9.

Figure 2:
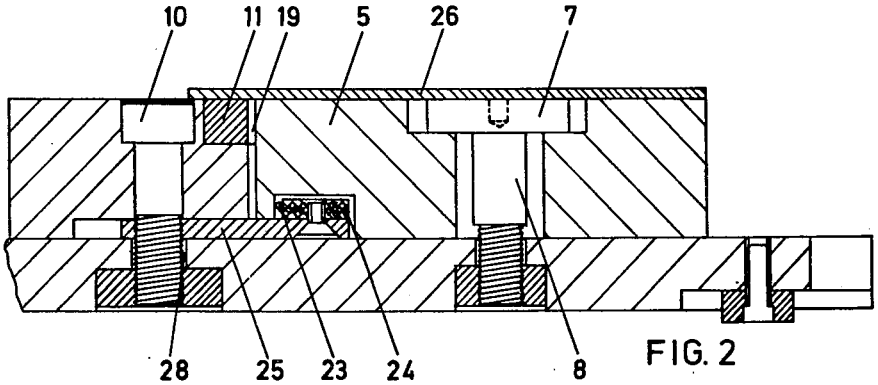
FIG. 2 is a section through the vise taken along the line A—A of FIG. 1.
Figure 3:
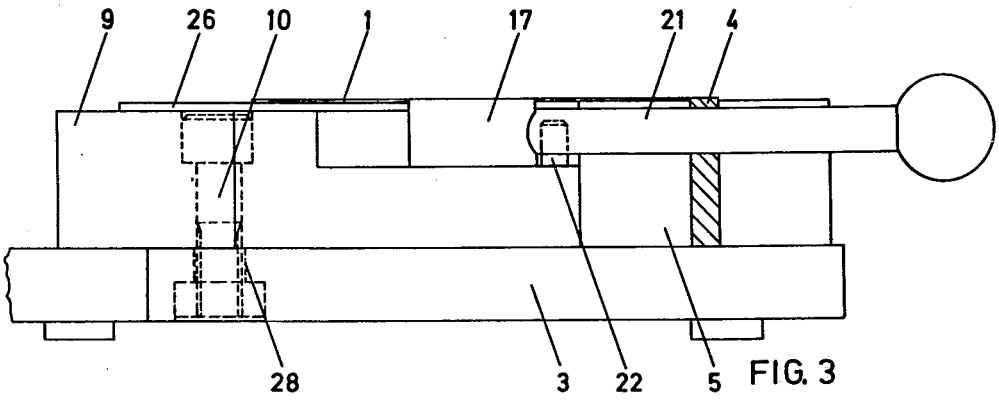
FIG. 3 is a side elevation of the vise, viewed in the direction of the arrow B of FIG. 1.
Figure 4:
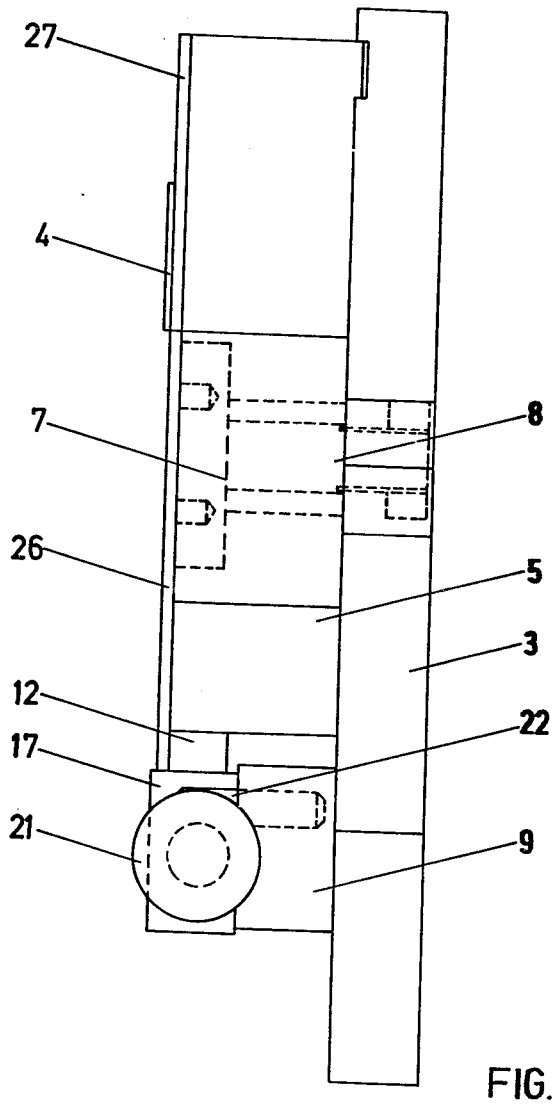
FIG. 4 is a side elevation of the vise, viewed in the direction of the arrow C of FIG. 1.

A moving jaw cover plate 26, shown in FIGS. 2 to 4 but omitted from FIG. 1, is secured to the moving jaw carrier 5 and is large enough to extend over the cam members 11 and 12 and the semicircular slides 19 and 20 so as to retain them in position. A corresponding fixed jaw cover plate 27 is provided over the mounting for the fixed rear jaw 2.

In use, for initial setting up the two Allen screws 10 are slackened and the spacing block 9 is slid along a milled slot 28 in the base plate until the jaws 1 and 2 are at approximately the correct spacing. A row of articles to be milled may then be placed between the two jaws, the spacing block 9 slid back along the milled slot 28 until the jaws are finger-tight against the row of work pieces, and the Allen screws 10 then tightened. At this stage the lever 21 is turned clockwise until it abuts the stop pin 22, moving the cam 17 to the position shown in FIG. 1. Initial anticlockwise movement of the cam 17 causes the wedge-shaped cam members 11 and 12 and the slides 19 and 20 to position themselves axially along the guide track to take up any free play that might have existed between them. Further anticlockwise movement of the lever 21 causes the wedge member 12 to push the slide 20 up the wedge face 14, resulting if appropriate in angular adjustment of the moving jaw carrier 5 until there is close contact between the articles at the right hand end of the row and the jaws 1 and 2. Further movement of the lever 21 causes movement of the cam member 11 along the guide track, pushing the slide 19 over the stop pin 18 and laterally out of the guide track. There may be further angular adjustment of the moving jaw carrier 5 at this stage, to bring the jaws 1 and 2 into close contact with articles at the left hand end of the row. Thereafter there is a continuous adjustment of the cam members 12 and 11 and the slides 20 and 19 as the lever 21 is turned further anticlockwise to the position shown in FIG. 1, with the slide 19 being urged progressively over the surface of the stop pin 18 and the slide 20 being urged progressively up the wedge face 14. The movable jaw carrier 5 moves to the right as viewed in FIG. 1 until any looseness between the articles along the row is taken up, this rightward movement being accompanied by sliding movement of the slides 19 and 20 over the smooth 45° surface of the jaw carrier 5. When all looseness in both directions has been taken up, clamping pressure is applied equally both longitudinally and laterally of the row, all by means of the single lever movement, and the row of articles is held firmly in two directions. It will be noted in particular that because of the side jaws 4 and 6 the work pieces are in compression one against the other along the length of the row. This enables a machining, for example milling, operation to be carried out across all of the work pieces in a single movement.

Once the vise has been set up as described above, all that is necessary to remove the work pieces and replace them with a further set of work pieces for milling is to turn the lever 21 clockwise to allow the return springs 23 to move the jaws slightly apart, whereupon the work pieces may be lifted out and a new row placed in position.

Depending on the nature of the workpieces to be held and of the machining operation, it may be desirable to incorporate a resilient member in the clamping means. In the embodiment illustrated this may be achieved by making the cam member 11 in two parts, separated by a spring or by a strip of resilient material, for example neoprene rubber.

Figure 5:
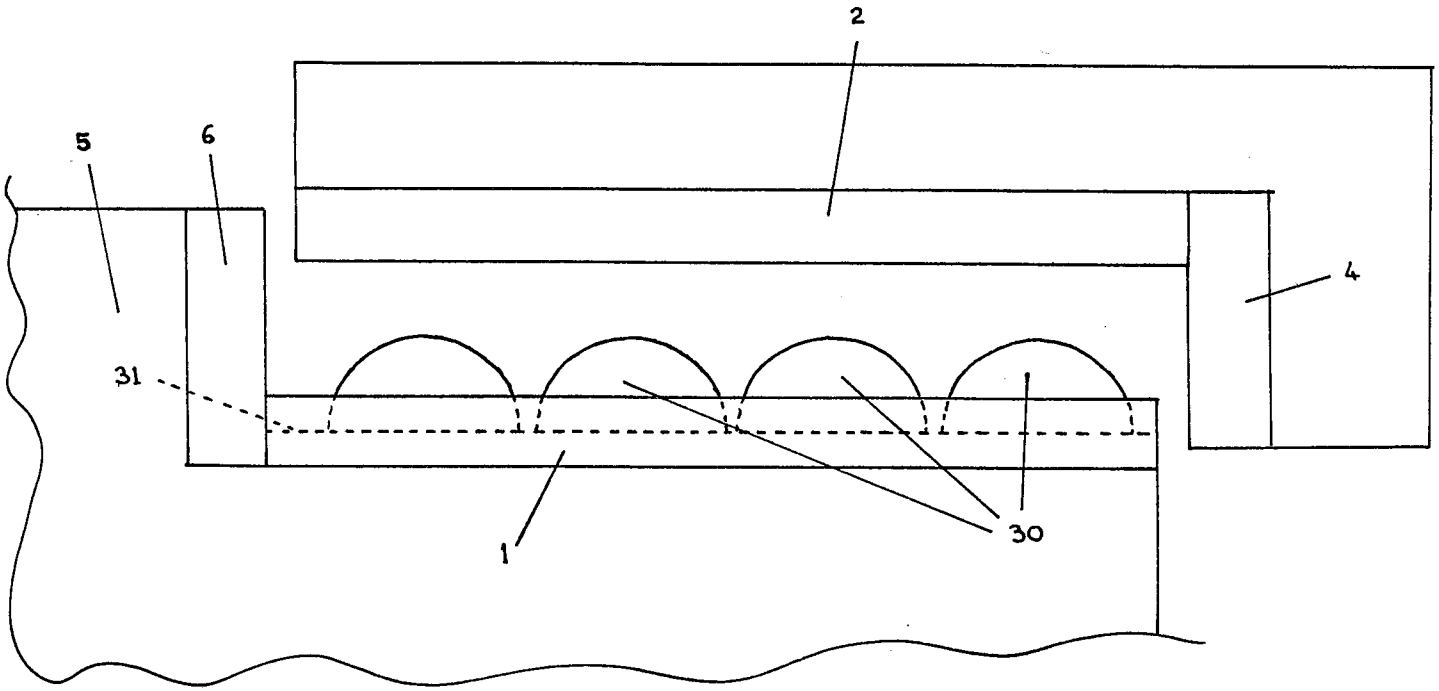
FIG. 5 is a plan view from above of the jaws of the vise of FIGS. 1 to 4, with a row of slidable thrust members in place in the front jaw.
Figure 6:
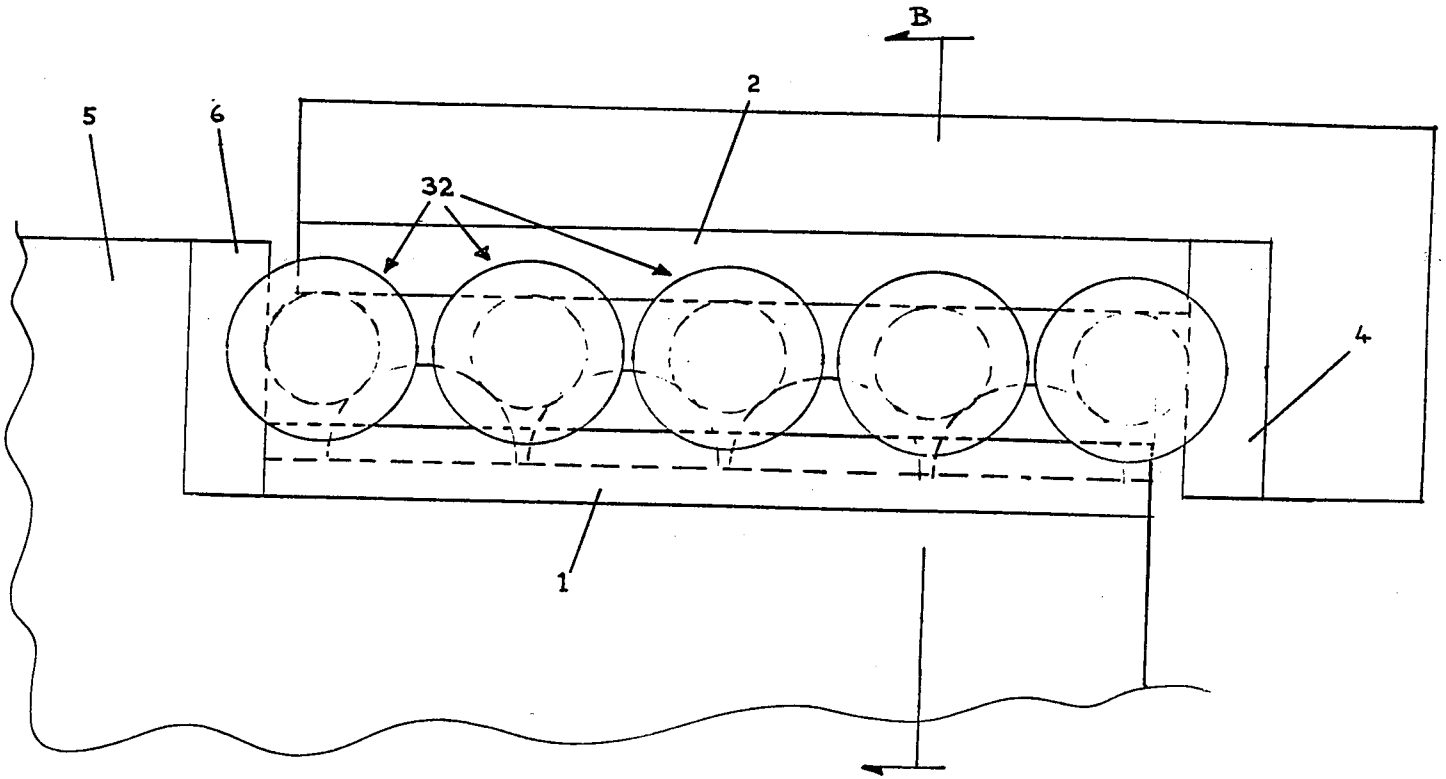
FIG. 6 is the same plan view as FIG. 5, but showing a row of shouldered cylinder in position between the jaws.
Figure 7:
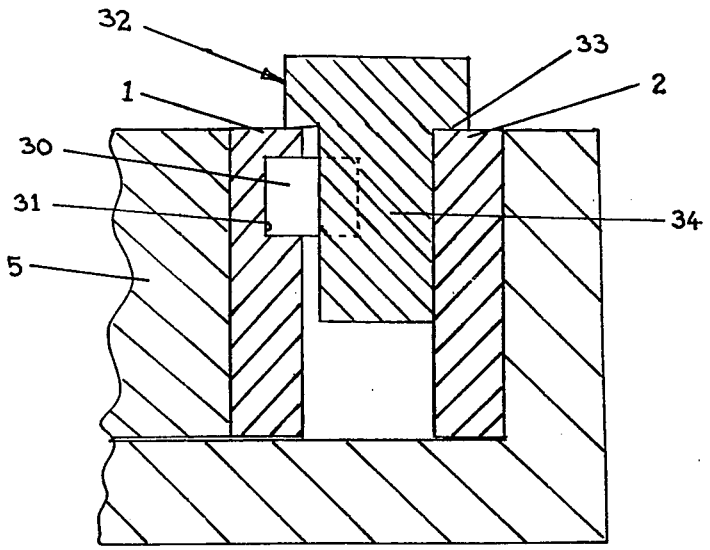
FIG. 7 is a vertical section taken along the line B—B of FIG. 6.

FIGS. 5 to 7 show a modification to the front jaw 1 which allows a row of articles of different sizes to be held. A row of four hemicylindrical pressure members 30 is mounted in a recessed housing 31 extending longitudinally of the jaw 1. Each pressure member 30 is a sufficiently accurate fit to be retained in the housing 31 when the jaws are open as in FIG. 5, but is freely slidable longitudinally of the housing.

FIGS. 6 and 7 show how the pressure members 30 engage and clamp a row of shouldered cylinders 32. Each cylinder 32 has a shouldered portion engaging the top surface of the rear jaw 2 and a stem portion 34 depending between the jaws. As the jaws are closed together the pressure members 30 close against the stem portions 34 and there is a general sliding and repositioning of the members 30 and the cylinders 32 until each pressure member engages a pair of adjacent stem portions 32 and each stem portion 32 engages the rear jaw 2. The sliding and repositioning is achieved because the portions of the pressure members 30 contacting the stem portions 34 are inclined in opposite directions.

When the jaws are fully tightened together, equal clamping pressure is imparted to each of the cylinders 32 in the row. Also the cylinders are slightly spaced one from another, which is desirable if interference between their shoulders is to be avoided.

Instead of hemicylindrical pressure members 30, wedge-shaped members of a generally triangular section could if desired be used.

I claim:

1. A vise for holding a row of discrete articles, comprising:

a base plate;

a front vise jaw:

a first side jaw fast to one end of the front vise jaw;

a rear vise jaw spaced from the front jaw;

a second side jaw fast to one end of the rear vise jaw and facing the first side jaw across the space between the front and rear jaws, the rear vise jaw and second side jaw being secured fast to the base plate;

means mounting the front jaw and first side jaw to be linearly and angularly movable relative to the rear jaw and second side jaw, the mounting means being slidable over the base plate but retained in close contact with the base plate by means of a stud on the base plate overlying an upper surface of the mounting means; and means for moving the mounting means towards the rear jaw and the second side jaw to effect clamping of a row of articles simultaneously between the front and rear jaws and along the length of the row between the first and second side jaws.

2. A vise according to claim 1, wherein the means for moving the mounting means comprises a single control member effective to clamp the row of articles in both directions at once.

3. A vise according to claim 2, wherein the control member is a lever acting on cam means.

4. A vise according to claim 3, wherein the means for moving the mounting means comprises a row of wedge elements which, on movement together, urge one or more slide members transversely of the row to urge the mounting means generally towards the junction of the rear and second side jaws.

5. A vise according to claim 4, wherein there are two wedge members and a fixed stop member in the row, and movement of one of the wedge members at one end of the row towards the stop member at the other end of the row causes a pair of slide members to be urged transversely of the row to provide a bias at two spaced points or zones on the mounting for the front jaw.

6. A vise according to claim 5, wherein the slide members are generally hemicylindrical with the curved faces abutting inclined surfaces of the wedge members and with one of the curved faces abutting also the stop member.

7. A vise for holding a row of discrete articles, comprising:

a generally L-shaped front jaw assembly;

a generally L-shaped rear jaw assembly;

means mounting the front and rear jaw assemblies to define a space for a row of discrete articles between two pairs of opposed faces of the jaw assemblies, said means permitting linear and angular movement of the front jaw assembly relative to the rear jaw assembly;

wedge means for urging the front jaw assembly towards the rear jaw assembly, comprising a row of alternating wedge and slide members, means for closing together the wedge members of the row to urge the slide members transversely of the row from between adjacent wedge members, and first and second means coacting with the wedge members and slide members respectively for transmitting the transverse movement of the slide members to the jaw assemblies.

8. A vise according to claim 7, wherein the front jaw assembly comprises a mounting plate incorporating the second coacting means, a front and side jaw support structure slidable relative to the mounting plate to effect coarse adjustment of the vice, and means for clamping together the mounting plate and the support structure.

9. A vise according to claim 8, wherein the front jaw assembly comprises a front jaw on which are slidably mounted pressure members, each pressure member being slidable longitudinally of the row and comprising oppositely inclined surface portions for contacting respective ones of a pair of adjacent articles in the row.

10. A vise according to claim 1, wherein one of the front and rear jaws mounts a row of pressure members each freely slidable longitudinally of the jaw on which it is mounted and presenting oppositely inclined contact surface portions to adjacent articles to be held in the vise.

11. A vise according to claim 9 or claim 10, wherein the pressure members are mounted in a longitudinal groove in the appropriate jaw.

* * * * *